US005513623A

United States Patent [19]

Hong

[11] Patent Number: 5,513,623

[45] Date of Patent: May 7, 1996

[54] PORTABLE GAS COOKING DEVICE

[76] Inventor: Young P. Hong, 3405 Dogwood Dr., Ellicott City, Md. 21043

[21] Appl. No.: 542,878

[22] Filed: Oct. 13, 1995

[51] Int. Cl.[6] ..... F24C 5/20

[52] U.S. Cl. ..... 126/38; 126/40; 126/373

[58] Field of Search ..... 126/38, 40, 9 R, 126/39 R, 373, 376, 343.5 A, 344, 345; 431/344, 142, 143, 258

[56] References Cited

U.S. PATENT DOCUMENTS

| | | | |
|---|---|---|---|
| 2,853,126 | 9/1958 | Corlet | 126/38 |
| 3,213,848 | 10/1965 | Wei | 126/40 |
| 3,745,987 | 7/1973 | Dribhenki | 126/38 |
| 3,907,490 | 9/1975 | Schaller | 431/344 |
| 4,082,993 | 4/1978 | Oakes | 126/40 |
| 4,284,058 | 8/1981 | Lutz | 126/38 |
| 4,461,271 | 7/1984 | Juang | 431/344 |
| 4,726,350 | 2/1988 | Steinhauser | 126/40 |

FOREIGN PATENT DOCUMENTS

| | | | |
|---|---|---|---|
| 527925 | 10/1940 | United Kingdom | 126/38 |

*Primary Examiner*—James C. Yeung
*Attorney, Agent, or Firm*—Birch, Stewart, Kolasch & Birch

[57] ABSTRACT

A portable gas cooking device for use outdoors, includes a cooking container, a gas burner, and a gas tank disposed within and stacked up from the top to the bottom of an insulated housing for cooking during transportation thereof without safety and leakage problems.

11 Claims, 1 Drawing Sheet

PORTABLE GAS COOKING DEVICE

BACKGROUND OF THE INVENTION

1. Field of the Invention

The present invention relates to a portable cooking device for use outdoors and more particularly, to a portable gas cooking device having a cooking container, a gas burner, and a gas tank disposed within and stacked up from the top to the bottom of an insulated housing for cooking during transportation thereof without safety and leakage problems.

2. Description of Related Art

Various types of gas cooking devices having a gas burner and a gas source are known in the art. Generally, the gas burner is operated by a gas controlling valve or switch, and the gas burner is provided with container supports for supporting the container disposed over the burner.

Such gas cooking devices are shown in U.S. Pat. No. 3,213,848 to Wei, U.S. Pat. No. 4,082,993 to Oakes, and U.S. Pat. No. 4,726,350 to Steinhauser. However, such gas cooking devices do not disclose an actually portable cooking device containing a pot, a burner, and a gas tank with an automatic igniting system. Also, such cooking devices do not show a cooking device to enable cooking during transportation of the cooking device without safety and leakage problems.

SUMMARY OF THE INVENTION

Accordingly, it is an object of the present invention to provide a portable gas cooking device for use outdoors, which eliminates the above problems encountered with conventional gas cooking devices.

Another object of the present invention is to provide a portable gas cooking device including a cylindrical housing, a replaceable gas tank, a gas burner member with an automatic igniting system, and a cooking container with a lid screwed to the cooking container whereby the portable gas cooking device can be effectively operated outdoors even though the weather is bad, and conveniently used during movement/transportation thereof.

Still another object of the present invention is to provide a portable gas cooking device, which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to an improved portable gas cooking device including a cooking container such as a pot or a kettle, a gas burner member, and a gas tank disposed within and stacked within an insulated housing for cooking during transportation thereof without safety and leakage problems.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
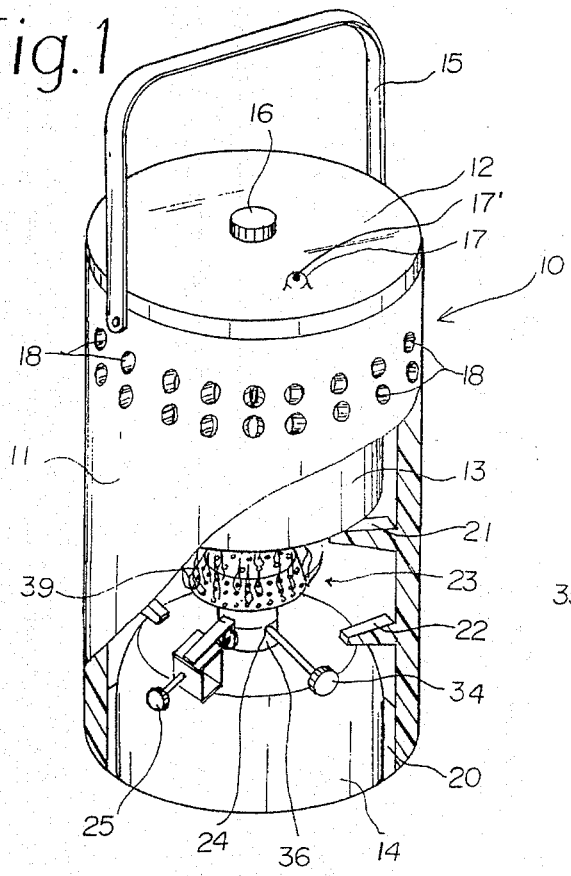
FIG. 1 is a perspective view of a portable gas cooking device according to the present invention containing cut away portions in order to illustrate construction of the device of the present invention.
Figure 2:
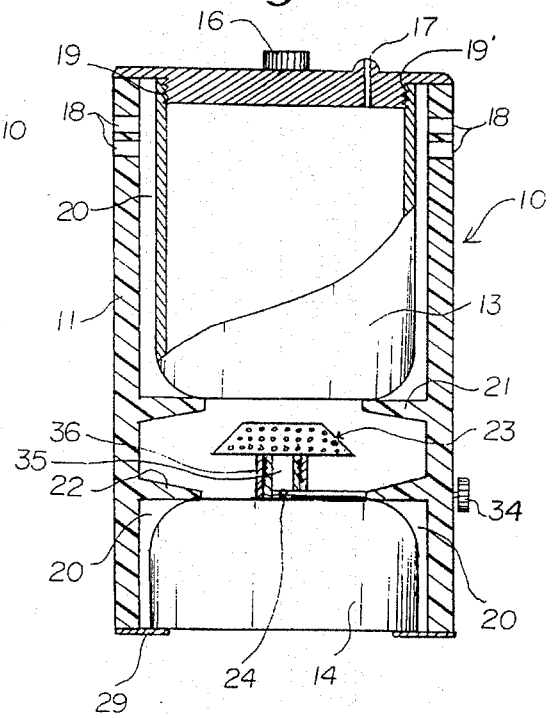
FIG. 2 is a sectional view of FIG. 1.

Referring now in detail to the drawings for the purpose of illustrating preferred embodiments of the present invention, the portable gas cooking device 10 as shown in FIGS. 1 and 2, includes a housing 11 having a pivotal handle 15 formed at an upper end of the housing 11, a gas tank 14 fit within the housing 11, a gas burner member 23 positioned over the gas tank 14, and a cooking container 13 positioned above the gas burner member 23. The housing 11 is made of insulating materials such as cellular plastics, glass fibers, or polystyrenes and has a cylindrical configuration.

As shown in FIG. 2, the housing 11 is provided with a plurality of stoppers 22 extending from an inner wall of the housing 11 for securely positioning the gas tank, and a plurality of gas tank supports 29 fixed to a bottom peripheral edge of the housing with screws 30 for supporting the gas tank 14 thereon (FIG. 3) so as to enable replacement of the gas tank 14 if necessary. An annular space 20 is formed in a base of the housing 11, preferably within a bottom surface thereof, for inducing fresh air therethrough so as to supply oxygen to the gas burner 23. Also, the housing 11 is further provided with a plurality of openings 18 disposed adjacent an upper end thereof for exhausting of the wasted hot air, smell, and smoke to the atmosphere. A lid 12 covers the upper end of the housing 11 by threadably engaging with an inner threaded portion 19 an opening of the cooking container 13 and an outer threaded portion 19' of the lid 12. The plurality of openings 18 are preferably formed as two parallel lines of openings 18. The lid 12 has a nipple 17 which has a small aperture 17' formed therein for generating whistle while the liquid of the cooking container 13 is boiling so as to indicate the state of cooking of food in the cooking container 13 and maintain the safety of the cooking container 13. A knob 16 or the like is provided on the upper surface of the lid 12 to assist in securement and removal thereof to the container 13.

The cooking container 13 is supported by a plurality of container supports 21 extending from the inner peripheral wall surface at substantially the middle portion of the housing 11 such that the cooking container 13 is disposed over a burner head 37 of the burner 36. The cooking container 13 is preferably a kind of kettle or pot. The cooking container 13 will boil rice or cook various types of soups therewithin even though the portable gas cooking device 10 is transported outdoors, for example, hiking or mountain climbing and the weather is bad such as a windy and/or rainey day.

Figure 4:
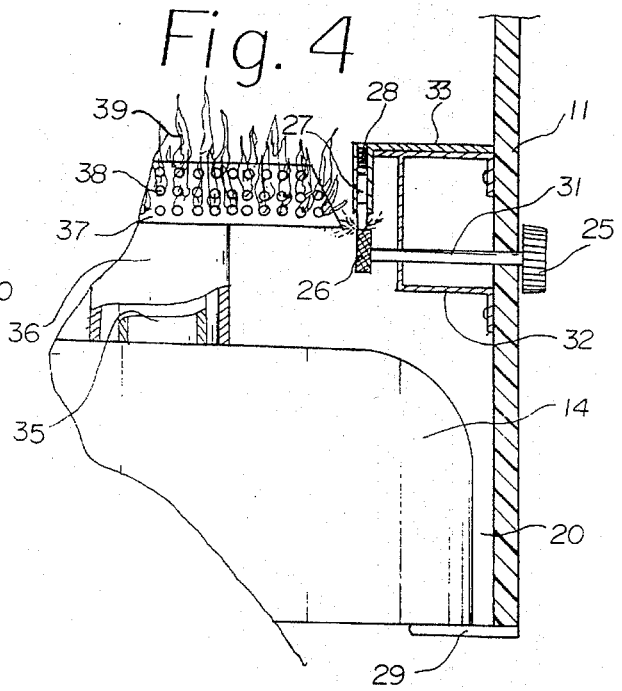
FIG. 4 is an enlarged sectional view of a gas burner member of the portable gas cooking device according to the present invention.

As shown in FIGS. 1 and 4, the gas burner member 23 includes a gas control valve 24, a burner head 37 having a plurality of gas openings 38, and a burner stem 36 containing a gas pipe 35 operatively communicating with the gas tank 14. The gas control valve 24 is operated by a gas controlling knob 34. Generally, the gas tank 14 contains LPG (liquefied petroleum gas) to be flowed to the plurality of gas openings 38 of the burner head 37 through the gas pipe 35 for transforming the LPG into a flame 39 (FIG. 4). The gas controlling knob 34 is disposed on the exterior of the housing 11.

Figure 3:
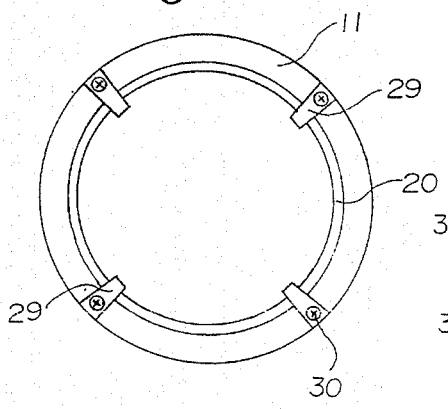
FIG. 3 is a bottom plan view of the portable gas cooking device according to the present invention.

As shown in FIGS. 1, 2, and 3, a knurled igniting knob 25 disposed on the exterior of the housing 11 and in the vicinity of the gas controlling knob 34 includes a threaded steel member 26 and a knob shaft 31 connected between the knurled igniting knob 25 and the threaded steel member 26. The knob shaft 31 is supported by a C-shaped shaft support 32 fixed to the inner wall of the housing 11. A lighter flint 27 is biased by a spring 28 which is supported by an L-shaped lighter flint support 33 and attached to the upper part of the C-shaped shaft support 32 for igniting fire 39 to the burner head 37, so that it is easy to strike fire a spark.

Accordingly, the gas cooking device 10 for use outdoors according to the present invention can be used in any weather condition, for example, windy or rainy days, can effectively improve heat efficiency, can be conveniently cook even during movement of the cooking device 10, and can guarantee the safety and non-leakage thereof. Also, it is convenient and economical since the exhausted gas tank 14 can be easily replaced with a new one and the cooking device 10 includes an automatic ignition system disposed therewithin, and it is simple in structure, inexpensive to manufacture, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A portable gas cooking device for use outdoors, comprising:

a housing including a pivotal handle, a lid, a plurality of gas tank positioning members formed on one inner wall of said housing and disposed thereof, and a plurality of air openings formed in an upper portion thereof;

a gas tank securely positioned by said plurality of gas tank positioning members of the housing;

a gas burner member supported on said gas tank, said gas burner member including a gas control valve, a burner head operatively communicating with said gas tank, and a burner stem supported on said gas tank for supporting said burner head, said gas control valve being operated by a gas controlling knob disposed on the exterior of said housing;

an igniting member in the vicinity of said gas burner member, the igniting member including a threaded steel portion connected to a knurled igniting knob disposed on the exterior of said housing through a knob shaft, and a light flint in the vicinity of said threaded steel portion for supplying gas to the burner head; and a cooking container disposed over the burner head of said gas burner member, said cooking container having a threaded portion disposed on a mouthpiece thereof for threadably connecting to a corresponding threaded portion of said lid, whereby the portable cooking device can be conveniently used in bad weather and outdoors without safety and leakage problems and can effectively improve heat efficiency and substitution of the gas tank.

2. The portable gas cooking device of claim 1, wherein said lid includes a nipple, and a small aperture formed within the nipple for generating a whistle sound while the liquid of the cooking container is boiling.

3. The portable gas cooking device of claim 1, wherein said housing has a cylindrical configuration.

4. The portable gas cooking device of claim 3, wherein said housing is made of a material selected from the group consisting of cellular plastic, glass fiber, and polystyrene.

5. The portable gas cooking device of claim 1, wherein said gas tank houses a liquefied petroleum gas (LPG) .

6. The portable gas cooking device of claim 1, wherein said burner head has a plurality of openings formed therein for communicating with said gas tank through a gas pipe disposed within said burner stem.

7. The portable gas cooking device of claim 1, wherein said knob shaft is supported on a C-shaped shaft support fixed to the inner wall of said housing.

8. The portable gas cooking device of claim 7, wherein said lighter flint and a spring are supported by an L-shaped lighter flint support fixed to the inner wall of said housing and attached to the upper part of said C-shaped shaft support.

9. The portable gas cooking device of claim 1, wherein said cooking container is a container selected from the group consisting of a kettle and a pot.

10. The portable gas cooking device of claim 1, wherein said cooking container is supported on a plurality of container supports extending from the inner wall of said housing.

11. The portable gas cooking device of claim 1, wherein said gas tank, burner member, and cooking container are spaced apart within said housing such that fresh air will circulate from the lower portion to the plurality of air openings of said housing.

* * * * *